US008448923B1

(12) United States Patent
Schad et al.

(10) Patent No.: US 8,448,923 B1
(45) Date of Patent: May 28, 2013

(54) ELEVATED SURFACE SAFETY BASE AND POST APPARATUS

(76) Inventors: Dane Avery Schad, Kansas City, MO (US); Brent Edward Smith, Kansas City, MO (US)

( * ) Notice: Subject to any disclaimer, the term of this patent is extended or adjusted under 35 U.S.C. 154(b) by 0 days.

(21) Appl. No.: 13/421,573

(22) Filed: Mar. 15, 2012

(51) Int. Cl.
*E04G 3/34* (2006.01)

(52) U.S. Cl.
USPC ..... 256/59; 256/DIG. 6; 256/65.03; 256/68

(58) Field of Classification Search
CPC ..... E04G 3/334
USPC ..... 256/59, 65.03, 65.04, 68, 69, DIG. 5, 256/DIG. 6; 521/DIG. 12; 182/113
See application file for complete search history.

(56) References Cited

U.S. PATENT DOCUMENTS

| | | | | | |
|---|---|---|---|---|---|
| 3,938,619 | A * | 2/1976 | Kurabayashi et al. | ..... | 182/113 |
| 3,995,833 | A * | 12/1976 | McLaughlin et al. | ..... | 256/59 |
| D331,529 | S * | 12/1992 | Reinklou | ..... | D8/73 |
| 6,038,829 | A * | 3/2000 | Franks | ..... | 52/645 |
| 6,039,150 | A * | 3/2000 | Palmer | ..... | 182/113 |
| 6,336,623 | B1 * | 1/2002 | McCarthy | ..... | 256/64 |
| 6,585,080 | B2 * | 7/2003 | Murray | ..... | 182/45 |
| 7,377,491 | B2 * | 5/2008 | Fuoco | ..... | 256/65.03 |
| 7,806,232 | B2 * | 10/2010 | Thomas et al. | ..... | 182/45 |

* cited by examiner

*Primary Examiner* — Joshua Kennedy

(57) ABSTRACT

A safety apparatus for use on an elevated surface, for providing fall protection for multiple elevated surface configurations, so as to adaptably secure a safe work environment, the safety apparatus comprising a base member, wherein the base member includes a vertical mounting surface and a horizontal mounting surface, a stanchion, a first vertical clamping surface near the base of the stanchion, an adjustable clamp arm having a second clamping surface, wherein the clamp arm is operable to be attached to the stanchion in a horizontal slab clamp configuration, and at least one bracket operable to receive a horizontal fall protection barrier.

2 Claims, 6 Drawing Sheets

ELEVATED SURFACE SAFETY BASE AND POST APPARATUS

FIELD OF INVENTION

The present invention relates generally to a safety rail base and post for use on an elevated surface such as a roof for fall prevention. In particular the invention relates to a safety rail base and post for use on or near the edge of various types of elevated surface, such as a roof with a low edge, a low edge with a gravel stop, a parapet wall, and a concrete slab, and for compact storage of said rail base and post.

BACKGROUND

Federal and state regulations, as well as insurance providers, require the use of safety systems to prevent workers from falling from elevated surfaces during construction or maintenance repairs. In certain instances if the proper safety procedures are not followed, governmental organizations such as Occupational Safety and Health Administration (OSHA) can levy fines against companies and building owners due to non-compliance.

The safety systems are important from a regulation standpoint as well as good business practice. Safety systems protect workers from accidental falls and the resulting injuries or death that can occur. Minimizing these types of accidents and the resultant repercussions is important to protect life and limb as well as to reduce liabilities.

Often construction and maintenance/repair companies encounter numerous types of elevated edges, including flat edges, raised edges such as gravel stops, parapet walls, and slab overhangs. These various edges may be encountered on different job sites, a single job site, or even on a single building, and therefore construction companies currently need various types of safety rail bases. For that reason, there are various types of safety rail bases in the prior art; however the construction company must keep the various bases on hand or purchase them when required. This results in large costs and extra storage dedicated to safety equipment. There exists more versatile safety rail bases which are compatible with up to two of the various types of elevated surface edges, thereby decreasing the chance of multiple bases being required on a given jobsite; however construction companies prefer being able to use a single base for three or more of the types of elevated edges that they encounter.

Similarly, construction companies must choose between the available horizontal fall protection barrier types, including, but not limited to, lumber-based rails, metal rails, and cable systems. This is further complicated by the fact that currently there does not exist in the prior art any base and post apparatus that receives multiple types of horizontal barrier types. For example, if a construction company requires a lumber rail for a first job and a cable system for a second job, the company must purchase or rent two entire apparatus systems. Furthermore, not every type of base is produced for every type of horizontal system. This forces construction companies to purchase different brands of railing system, which is undesirable because construction companies often have developed business relations or trust with specific safety product manufacturers.

Lastly, construction sites are often complicated, dangerous places with many hazards and limited space. Therefore it is desirable to store and transport all of the parts of a single base and post (i.e. stanchion) together as a single unit. Keeping the parts in this way minimizes the necessary storage space required and minimizes the risk of losing parts when not in use. Currently there does not exist a parapet clamp base and post which can be stored compactly and as a single unit; that is, the current parapet clamps must be disassembled to store compactly, in which case the parts are separate and can be lost.

SUMMARY OF THE INVENTION

The present invention is a safety rail base and post apparatus 100 for attachment to an elevated surface. The safety rail base and post includes an anchor plate member, a stanchion, a first vertical clamping surface, an adjustable clamp arm having a second clamping surface, configurable to be attached to flat edges, raised edges, parapet walls, and slab overhangs, and at least one bracket operable to receive a lumber rail, metal rail, and tensioned cable.

The safety rail system design provides a temporary railing system for installation on the perimeter of an elevated surface to ensure that when a worker is on the elevated surface that all government regulations and insurance requirements are met for use of proper safety railings.

A further object of the invention is to provide a safety base and post that is configurable to be mounted on flat edges, raised edges, parapet walls, and slab overhangs. By providing a base and post that can be used on any one of these elevated surfaces, a construction company can more readily protect against fall hazards without having to purchase numerous bases and posts.

A further object of the invention is to provide a safety base and post having an adjustable bracket that is configurable to receive a lumber-based horizontal barrier, a metal steel horizontal barrier, and a tensioned cable. By providing a base and post having an adjustable bracket configurable to receive any of these types of horizontal barriers, a construction company can more easily adapt its safety plan to the requirements of the job site and limit the amount of safety equipment required.

A further object of the invention is to provide a safety base and post configurable to be compactly stored as a single unit. This will enable construction companies to reduce consumption of valuable space on job sites, reduce the number of hazards presented by a stored safety unit, and reduce the chance of parts becoming lost or misplaced due to disjointed storage.

Other objects of the present invention relating to an adaptable safety base and post configurable for numerous elevated edges and horizontal barrier types will become readily apparent upon reading the following detailed description in conjunction with the accompanying drawings and claims.

BRIEF DESCRIPTION OF THE DRAWINGS

The accompanying drawings illustrate embodiments of the invention and are for illustration by way of example and not limitations.

DETAILED DESCRIPTION OF THE INVENTION

Figure 4:
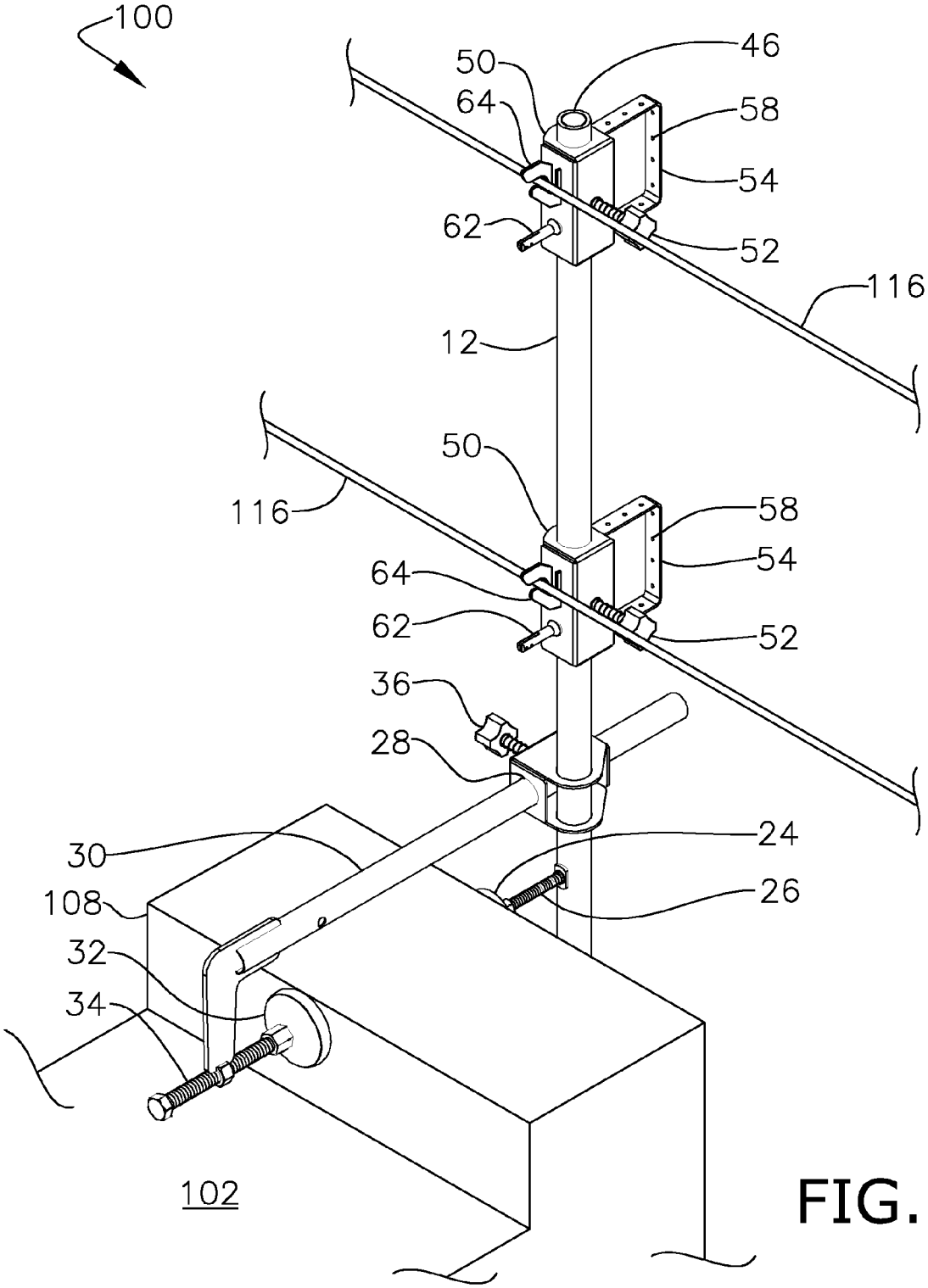
FIG. 4 illustrates a top perspective of a safety base and post installed on a parapet wall, in accordance with an embodiment of the invention.
Figure 5:
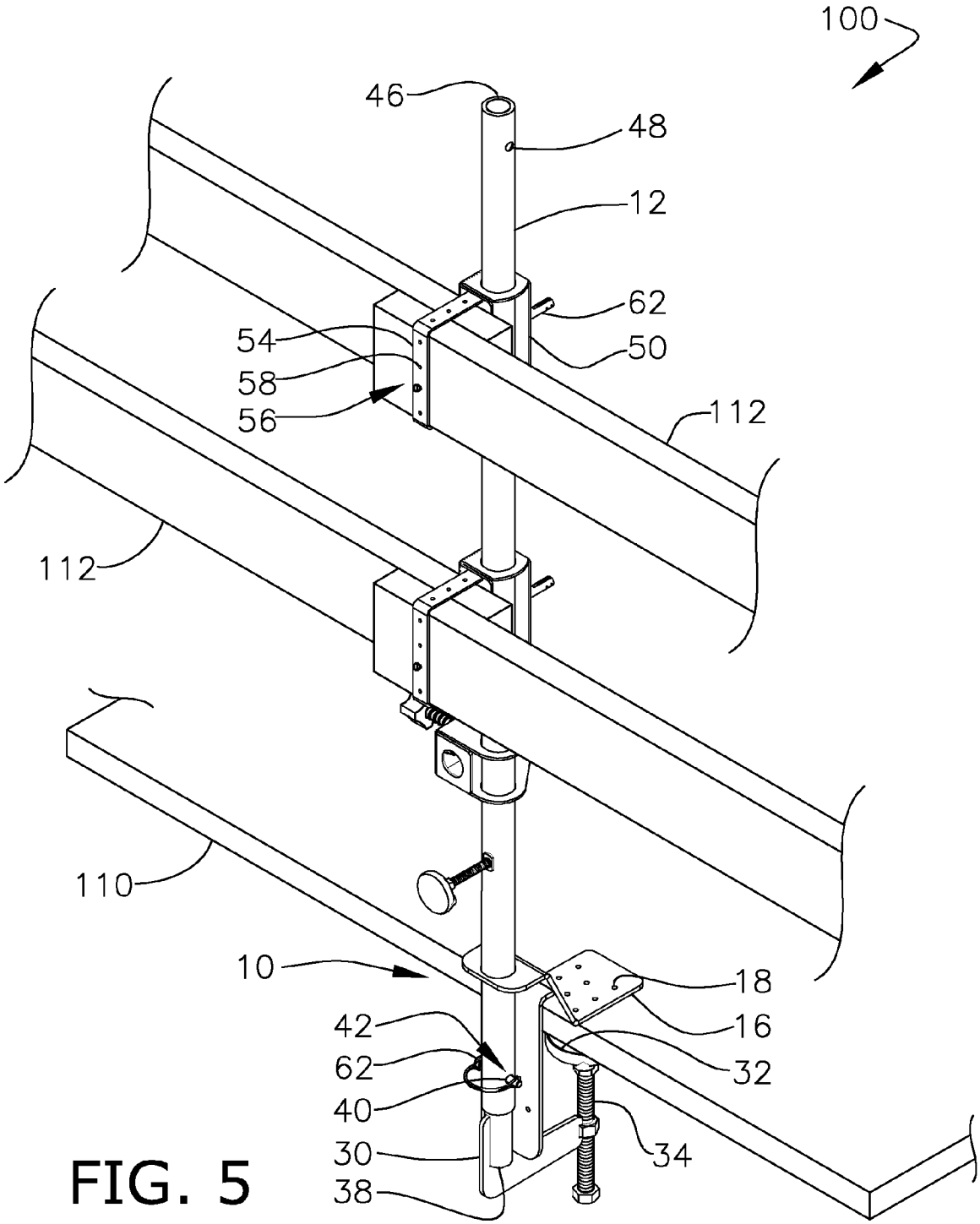
FIG. 5 illustrates a top perspective of a safety base and post installed on a slab overhang, in accordance with an embodiment of the invention.
Figure 6:
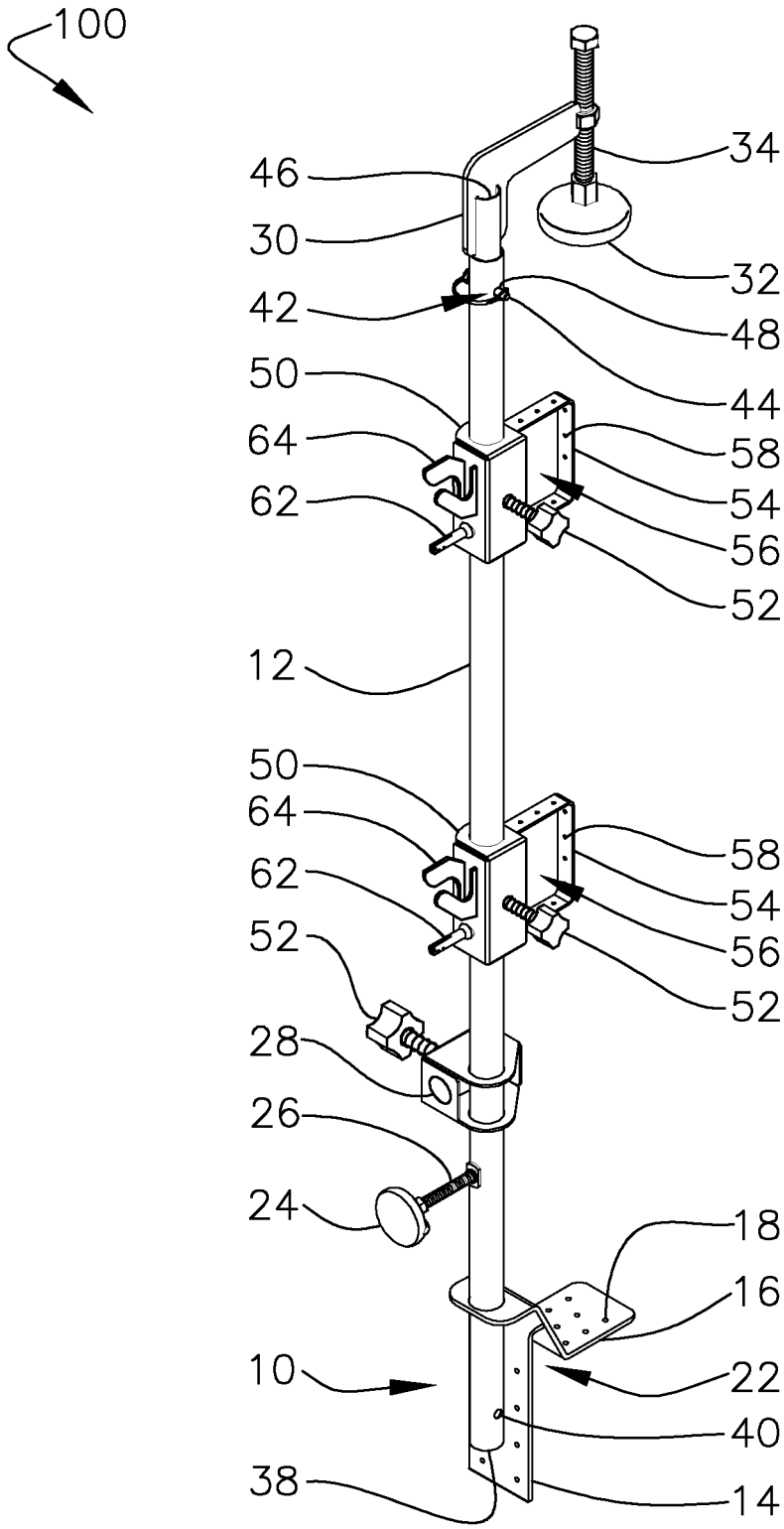
FIG. 6 illustrates a top perspective of a safety base and post in a stored configuration, in accordance with an embodiment of the invention.

The present invention is to a safety base and post apparatus as shown in FIGS. 1-6. Specifically, the invention is an adaptable safety rail and base apparatus 100 configurable to be installed on elevated surfaces such as that of a building 102 (FIG. 1), including flat edges 104 (FIG. 2), over raised edges 106 (FIG. 3), parapet walls 108 (FIG. 4), and slab overhangs 110 (FIG. 5), as well as being configurable to be compactly stored as a single unit (FIG. 6).

The safety base and post apparatus is shown in multiple views in FIGS. 1-6 and the invention presents an adaptable base and post, when used in conjunction with horizontal safety barriers provides a fall restraint on or near the edge of an elevated surface to aide in the safety of workers. As detailed in FIG. 2, the safety base and post apparatus 100 includes a base 10 and stanchion 12. The base 10 includes a generally vertical mounting surface 14 and generally horizontal mounting surface 16. The mounting surface 14 is preferably precisely vertical and the horizontal mounting surface 16 precisely horizontal, so as to form a right angle between the two surfaces; however in another embodiment it may be beneficial to provide surfaces 14, 16 having a relative angle as low as forty-five degrees and as high as one hundred and thirty-five degrees. The surfaces 14, 16 include at least one hole 18 for receiving at least one fastener 20. Preferably the surfaces 14, 16 include a plurality of holes 18 for receiving a plurality of fasteners 20. The fastener 20 can be a screw, lag bolt, nail, rivet, masonry anchor, or any other anchoring product used in the industry and designed for the desired building structure to attach the base 10 to the elevated surface 102. The fastener 20 is generally a roofing screw, concrete screw, or any fastener designed to structurally mount a railing system to a structure. The vertical mounting surface 14 and horizontal mounting surface 16 enables the apparatus to be mounted to a flat edge 104, i.e. a flat edge configuration. The base 10 is made of any material used in the industry to fabricated safety rail systems, including but not limited to metal, such as steel and aluminum, wood, plastic, other man-made materials, as well as any material approved for use to ensure the safety structure meets OSHA standards. In one embodiment, the base 10 is made of steel with a thickness of 1/16" to 5/16" of an inch. The base 10 itself and the base 10 and stanchion 12 together may be formed out of a single piece of material, or joined out of multiple pieces through manufactured processes such as welding, bonding, or fastening. In one embodiment the stanchion 12 is generally elongated and straight; however, in certain instances it may be preferable for the stanchion 12 to have at least one bend so as to create an offset between the distal ends of the stanchion 12. The stanchion further is preferably tubular and even more preferably a round tube.

Figure 3:
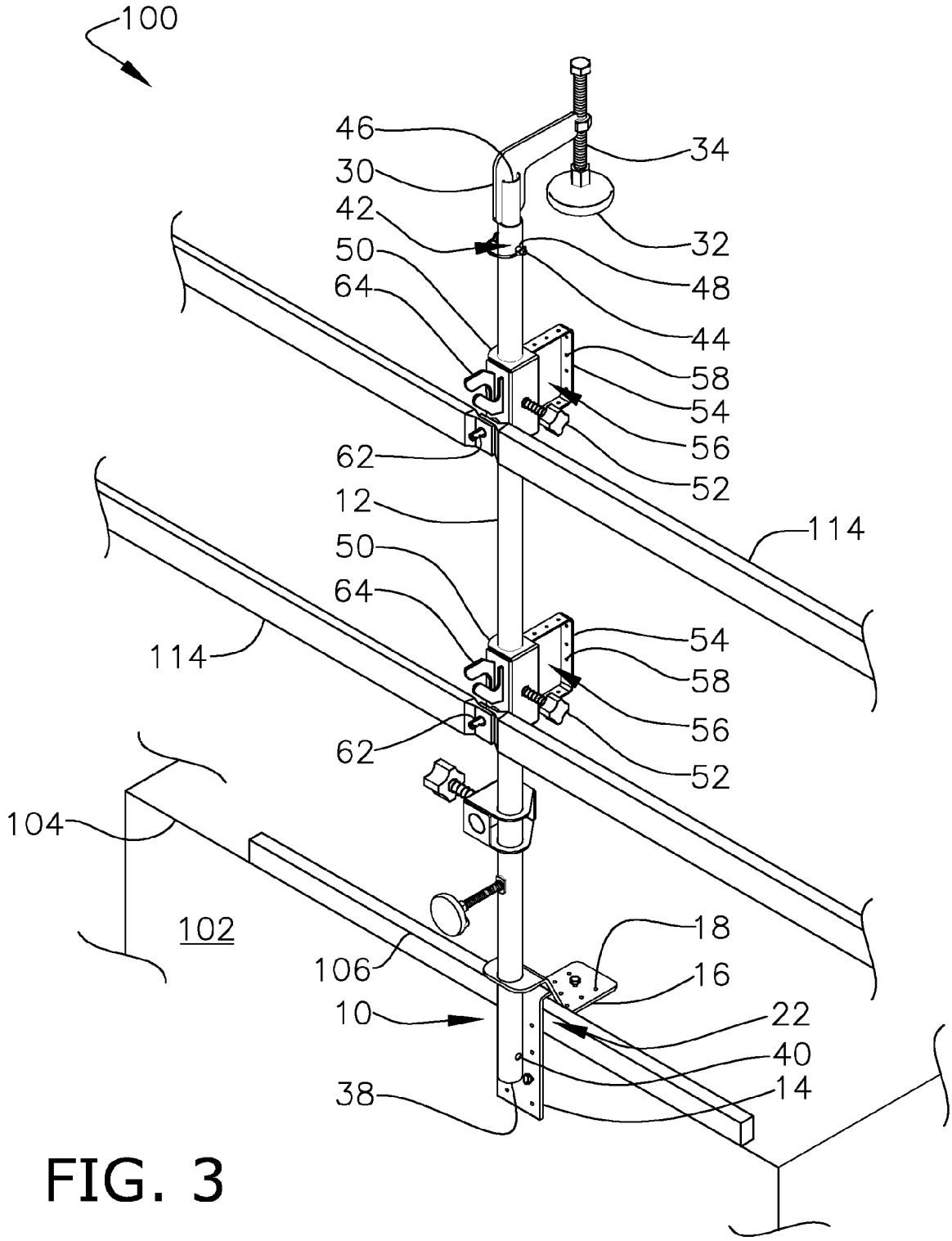
FIG. 3 illustrates a top perspective of a safety base and post installed on a gravel stop edge, in accordance with an embodiment of the invention.

In another embodiment of the invention, and as shown in FIG. 3, the base 10 further includes a space 22 intermediate the mounting surfaces 14, 16 configured to accept a raised edge 106. This configuration enables the apparatus 100 to be mounted to surfaces 102 having a raised edge 106. Raised edges such as gravel stops are generally at most one inch high and one inch thick; therefore the space 22 is preferably no larger than one inch by one inch in size.

In another embodiment of the invention, and as shown in FIG. 4, the safety base and post apparatus 100 is further configured to clamp onto a parapet wall 108. In this embodiment, the apparatus 100 further includes a first vertical clamping surface 24. In a particular embodiment, the first vertical clamping surface 24 is attached preferably to the stanchion 12 by an adjuster 26. Alternatively the adjuster 26 may attach the clamping surface 24 to the base 10. The adjuster 26 is preferably adjustable, thereby enabling a user to alter the position or spacing of the first vertical clamping surface 24. The apparatus 100 further includes an intermediate opening 28 for at least partially receiving an adjustable clamp arm 30. In this embodiment the stanchion 12 and adjustable clamp arm 30 are preferably least partially tubular, and preferably made of round tube. The adjustable clamp arm 30 is generally L-shaped and includes a second clamping surface 32 near its distal end. An adjuster 34, preferably a screw-type adjuster, connects the second clamping surface 32 to the adjustable clamp arm 30. In this way, the second clamping surface 32 can be adjusted in relation to the adjustable clamp arm 30. A fastener 36 secures the adjustable clamp arm 30 in the intermediate opening 28. The fastener 36 is preferably a screw-type fastener but can be a clamp, latch, pin, or other fastener known in the art to fasten two members together. In this configuration, the first vertical clamping surface 24 and second clamping surface 32 are vertically parallel and operable to cooperatively clamp to a parapet wall 108. Further inserting the adjustable clamp arm 30 into the intermediate opening 28, tightening the fastener 36 and then tightening the adjusters 26 and 34 create a secure clamping of the parapet wall 108. Parapet walls generally vary in thickness from four inches to twenty-four inches, so the adjustable clamp arm 30 and adjusters 26 and 34 are operable to adjust the clamping surfaces 24 and 32 between four inches and twenty-four inches apart. The adjustable clamp arm 30 is made of any material used in the industry to fabricated safety rail systems.

In another embodiment of the invention, shown in FIG. 5, the apparatus 100 can be mounted to a slab overhang 110. In this embodiment, the apparatus further includes a lower opening 38. The lower opening 38 is preferably located distally on the bottom end of the stanchion 12. In this embodiment the stanchion 12 and adjustable clamp arm 30 are preferably tubular. In this configuration the adjustable clamp arm 30 is at least partially inserted into the lower opening 38. The stanchion 12 typically includes an auxiliary opening 40 near the lower opening 38. The adjustable clamp arm 30 includes a corresponding fastener opening 42. When the auxiliary opening 40 and fastener opening 42 are aligned, a fastener 44, typically a through-pin, is inserted through the auxiliary opening 40 and fastener opening 42, so as to secure the adjustable clamp arm 30 at least partially in the lower opening 38. In this configuration, the second clamping surface 32 and horizontal mounting surface 16 are horizontally parallel and thus can be moved adjacent to the bottom and top of a slab overhang 110, respectively. Tightening the adjuster 34 creates a secure clamping of the slab overhang. Slab overhangs are generally between two inches and twelve inches thick. Therefore the adjustable clamp arm 30 and adjuster 34 are operable to adjust the vertical offset between the clamping surface 32 and horizontal mounting surface 16 from between two inches and twelve inches.

In another embodiment of the invention, as shown in FIG. 6, the apparatus 100 can be compactly stored as a single unit. In this embodiment the apparatus 100 further includes an upper opening 46. In this embodiment the stanchion 12 and adjustable clamp arm 30 are preferably tubular. The upper opening 46 is preferably located distally on the top end of the stanchion 12. The adjustable clamp arm 30 is at least partially inserted into the upper opening 46. A storage opening 48 is located near the upper opening 48. When the storage opening 48 and fastener opening 42 are aligned, the fastener 44 is inserted through the storage opening 48 and fastener opening 42, thereby securing the adjustable clamp arm 30 in a storage configuration.

Figure 1:
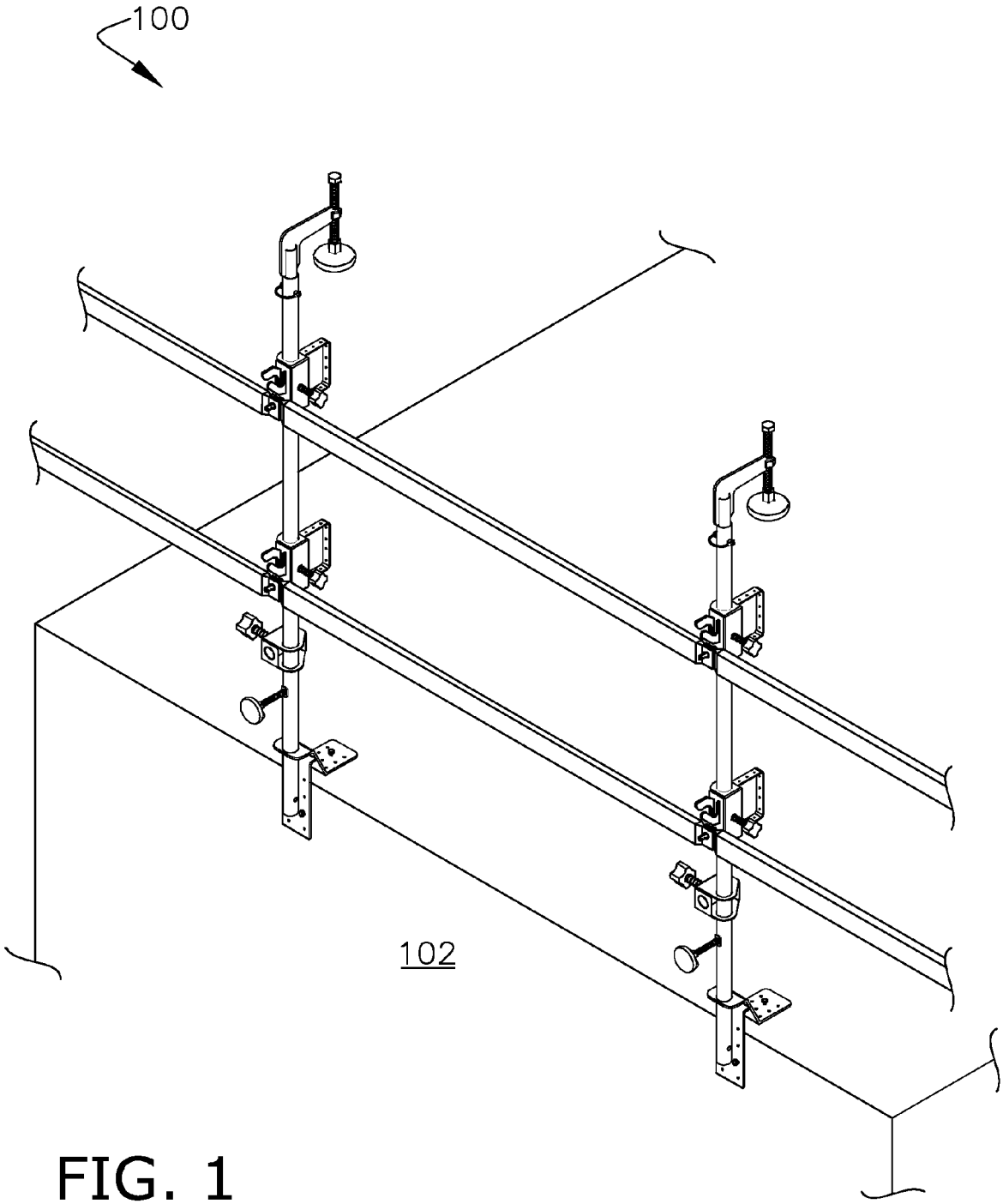
FIG. 1 illustrates a top perspective view of a safety base and post apparatus and horizontal barriers system installed on the perimeter of a building, in accordance with an embodiment of the invention.
Figure 2:
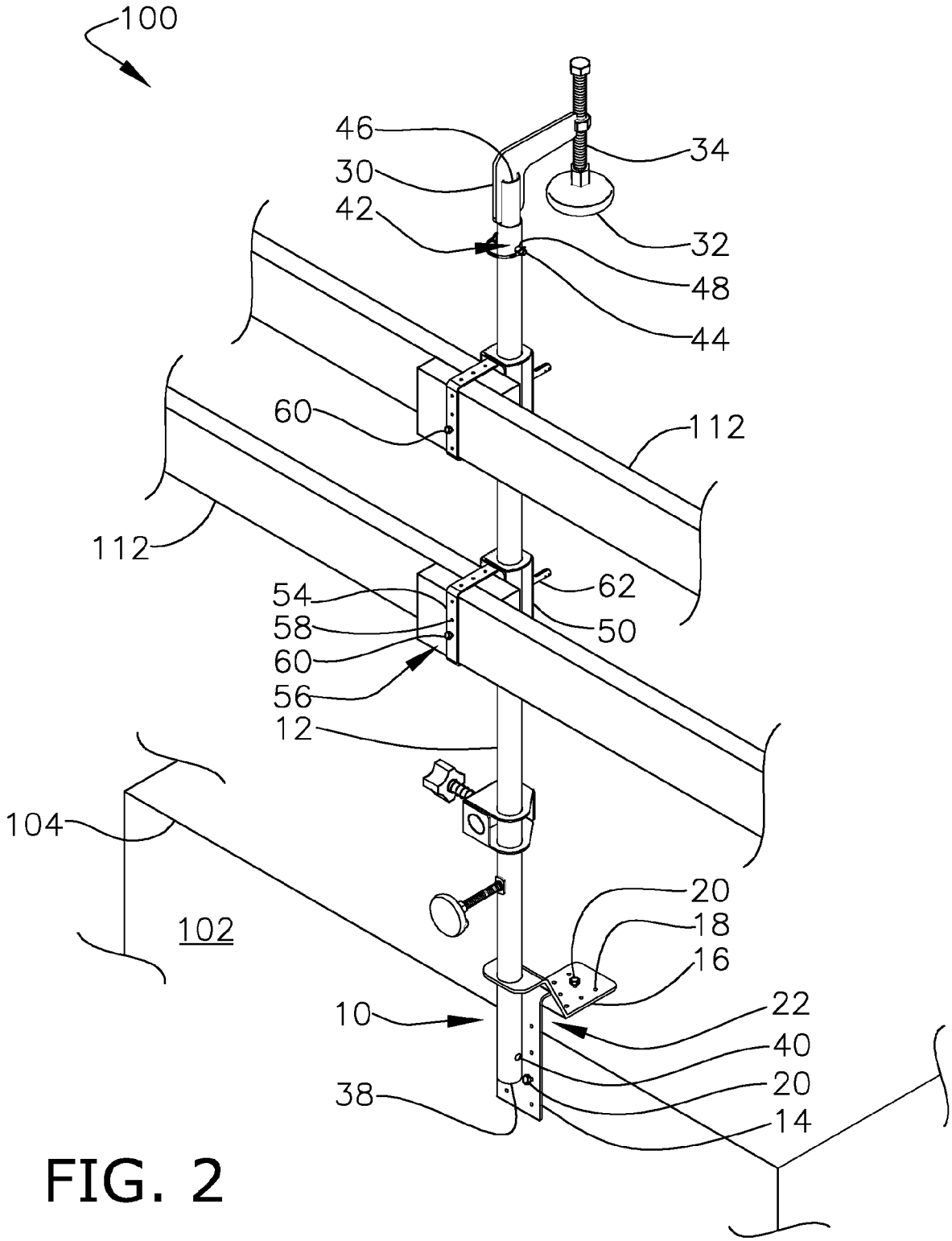
FIG. 2 illustrates a top perspective of a safety base and post installed on a flat edge, in accordance with an embodiment of the invention.

Turning again to FIGS. 2-4, the safety base and post apparatus 100 is operable to receive various horizontal barriers, including lumber type horizontal barriers 112 (FIG. 2), metal rail type horizontal barriers 114 (FIG. 3), and tensioned cable type horizontal barriers 116 (FIG. 4). The apparatus 100 generally includes at least one and preferably two brackets 50. More particularly, and as shown in FIG. 2, the bracket 50 can be positioned at various heights on the stanchion 12. The bracket 50 can also be positioned at various rotational angles, to be used on various architectural geometries such as corners and circular buildings, or for utilizing the other horizontal barriers such as metal rail and tensioned cable type barriers, detailed below, or for utilizing the various mounting and clamping configurations, as described above. A fastener 52, preferably a screw-type fastener, can be tightened to secure the bracket 50 at a specified height on the stanchion 12. The bracket 50 includes a guide 54 having a space 56 for receiving a lumber-based horizontal barrier 112. The guide 54 further includes at least one hole 58 for receiving a fastener 60 to secure the barrier 112 to the guide 54. Typical fasteners include but are not limited to screws, nails, pins, or other suitable fastener.

Similarly, and as shown in FIG. 3, the bracket 50 generally includes a pin 62 for receiving a metal rail type horizontal barrier 114. In a particular embodiment, the pin 62 and guide 54 are oppositely positioned on the bracket 50. To switch between utilizing the guide 54 and the pin 62, the bracket 50 is simply rotated 180 degrees and secured by tightening the fastener 60.

Similarly, the bracket 50 generally includes at least one hook 64 for receiving a tensioned cable 116. Preferably, the bracket 50 includes two oppositely facing hooks 64 offset from one another, which improves the ease with which a cable 116 is attached to the apparatus 100 without becoming unhooked.

Thus, there has been described a safety base and post assembly 100. It is apparent to those skilled in the art, however, that many changes, variations, modifications, other uses, and applications are possible, and also such changes, variations, modifications, other uses, and applications which do not depart from the spirit and scope of the invention are deemed covered by the invention, which is limited only by the claims which follow.

What is claimed is:

1. A safety apparatus for use on an elevated surface, the apparatus comprising: a base member, wherein the base member includes a vertical mounting surface and a horizontal mounting surface; a stanchion including a lower, intermediate, and upper opening, and at least one auxiliary opening near the lower and upper openings; a first vertical clamping surface near the base of the stanchion; an adjustable clamp arm having an adjustable second clamping surface located distally on the arm, and at least one fastener opening, wherein the clamp arm is operable to be attached to the stanchion in the lower, intermediate, and upper opening, in a horizontal slab clamp configuration, a parapet clamp configuration, and a stored configuration, respectively, and the adjustable second clamping surface is operable to be secured at a predetermined horizontal spacing from the first vertical clamping surface when the adjustable clamp arm is at least partially inserted into the intermediate opening, and operable to be secured at a predetermined vertical spacing from the horizontal mounting surface when the adjustable clamp arm is at least partially inserted into the lower opening; at least one fastener operable to be inserted through the auxiliary opening and fastener opening simultaneously, so as to secure the adjustable clamp at least partially in the lower and upper openings; at least one adjuster operable to secure the adjustable clamp at a predetermined location in relation to the intermediate opening; and at least one bracket operable to receive a horizontal fall protection barrier.

2. A safety apparatus for use on an elevated surface, the apparatus comprising: a base member, wherein the base member includes a vertical mounting surface, a horizontal mounting surface, and a space between the vertical and horizontal mounting surfaces; a stanchion including a lower, intermediate and upper opening; a first vertical clamping surface near the bottom of the stanchion; an adjustable clamp arm having a second clamping surface, wherein the clamp arm is operable to be attached to the stanchion in the lower, intermediate, and upper opening, so as to be in a horizontal slab clamp configuration and a parapet clamp configuration, and stored configuration respectively; at least one fastener operable to secure the adjustable clamp arm in the openings; and at least one bracket operable to receive a horizontal rail member, wherein the second clamping surface is adjustable and operable to be secured at a predetermined horizontal spacing from the first vertical clamping surface when the adjustable clamp is secured in the intermediate opening, and operable to be secured at a predetermined vertical spacing from the horizontal mounting surface when the adjustable clamp arm is secured in the lower opening.

* * * * *